United States Patent [19]

Underwood

[11] 4,227,625

[45] Oct. 14, 1980

[54] SEALING LID AND SEALING LID-CONTAINER COMBINATION

[76] Inventor: James L. Underwood, 104 Dixie Dr., Woodstock, Ga. 30188

[21] Appl. No.: 67,239

[22] Filed: Aug. 17, 1979

[51] Int. Cl.[3] ..... B65D 43/10; B65D 34/62; B65D 1/16

[52] U.S. Cl. ..... 220/307; 220/234; 220/233; 215/358; 217/78; 217/108

[58] Field of Search ..... 220/233, 234, 307; 215/358, 359; 217/78, 79, 108, 109

[56] References Cited

U.S. PATENT DOCUMENTS

| | | | |
|---|---|---|---|
| 3,080,993 | 3/1963 | Livingstone | 220/307 |
| 3,109,575 | 11/1963 | Aldington | 220/307 |
| 3,131,825 | 5/1964 | Sarafinas | 220/234 |
| 3,756,480 | 9/1973 | Swett | 220/234 |
| 4,027,776 | 6/1977 | Douglas | 220/307 |

FOREIGN PATENT DOCUMENTS

| | | | |
|---|---|---|---|
| 2103554 | 8/1971 | Fed. Rep. of Germany | 220/233 |

*Primary Examiner*—George E. Lowrance
*Attorney, Agent, or Firm*—Quaintance, Murphy & Richardson

[57] ABSTRACT

A lid for a plastic container, which container is particularly useful for containing paint, includes a sealing flange which engages the inner surface of a rim defining the opening of the container. The sealing flange is held in engagement with the rim by a plurality of locking tabs which are integral with the lid and fit beneath an inwardly projecting lip on the flange. The flange has a generally convex configuration while the rim has a concave configuration so that the lid is prevented from moving axially out of or into the container once it is locked in place by the tabs.

15 Claims, 4 Drawing Figures

SEALING LID AND SEALING LID-CONTAINER COMBINATION

BACKGROUND OF THE INVENTION

1. Field Of The Invention

This invention relates to sealing lids and sealing lid container combinations, and more particularly, this invention relates to sealing lids which lock in place to seal containers and are especially useful to seal paint containers made of plastic.

2. General Considerations and Prior Art

There are enormous numbers of paint cans and containers manufactured and used both in this country and throughout the world. Almost all paint cans now produced are made of metal with precision-fit lids which have projecting ribs that are frictionally received within a groove in the top of the cans in order to seal the cans. It is becomming increasingly apparent that plastic paint containers have certain advantages over metal cans. A primary advantage is that plastic containers are less expensive. Moreover, plastic containers can be made of materials which are inert with respect to the paint within the containers so that paint is not in danger of contamination by the can. Metal cans are generally made of steel and have a tin coating on the inside surface which is supposed to prevent interaction between the steel and paint. The paint can become discolored rather rapidly if the coating is improperly applied or becomes damaged so that the steel portion of the can is exposed to the paint. With oil base paints, this is not a great problem, however, with water based paints, such as vinyl paints which are becoming increasingly popular, this is an enormous problem because water tends to rust steel. When the rust disperses in the paint, the paint is usually ruined. Accordingly, as the demand for water based vinyl paints increases, so does the demand for quality plastic containers.

In order to be commercially viable, plastic containers must meet certain requirements. One of these requirements is that the containers can be readily substituted for metal cans without necessitating extensive changes in the filling and handling apparatus currently used with metal paint cans. Accordingly, plastic containers should be cylindrical so as to geometrically resemble metal paint cans and should have lids which are axially slid thereon to seal the containers.

One advantage to using the rib-in-groove structure relied on to seal the lids on metal cans is that contamination of paint within the cans due to damage to the tin layer during sealing is avoided. A major disadvantage of this sealing arrangement is that paint tends to collect in the groove so that when the lid is resealed, paint in the groove is displaced on to the lid and down the side of the can. With plastic paint containers this mess can be avoided because there is no need for such a groove. Exemplary of approaches, specifically of interest with respect to plastic paint containers, is applicant's copending patent application "Container and Lid of Molded Plastic Material", Ser. No. 917,588, filed June 21, 1978. While this approach has proved quite satisfactory, other approaches are needed because the plastic paint container industry is in its infancy and as it matures it needs a broad, diverse, technological foundation upon which to grow.

Although the foregoing discussion is directed particularly to the plastic paint container industry and that technology specifically developed to solve problems in that industry, the subject invention also has application to problems in other industries. Accordingly, the joint which is effected between the container and lid as described hereinafter may have other uses and applications.

SUMMARY OF THE INVENTION

It is an object of this invention to provide a new and improved lid for plastic containers for paint.

In view of this object, and other objects, the instant invention contemplates a closure in the form of a lid for a container wherein the closure engages an inner wall of the container and includes a bifurcated securing portion comprising a flange which abuts the inner wall of the container and a locking web or tab which secures the flange. The flange extends beyond the locking web and the locking web seats behind the flange and beneath a lip on the flange to positively hold the flange in abutement with the inner wall of the container. Moreover, the instant invention contemplates contours on the flange which complement similar, but oppositely disposed, contours on the inner wall of the container to prevent axial movement of the flange with respect to the container.

DESCRIPTION OF THE PREFERRED EMBODIMENT

Figure 1:
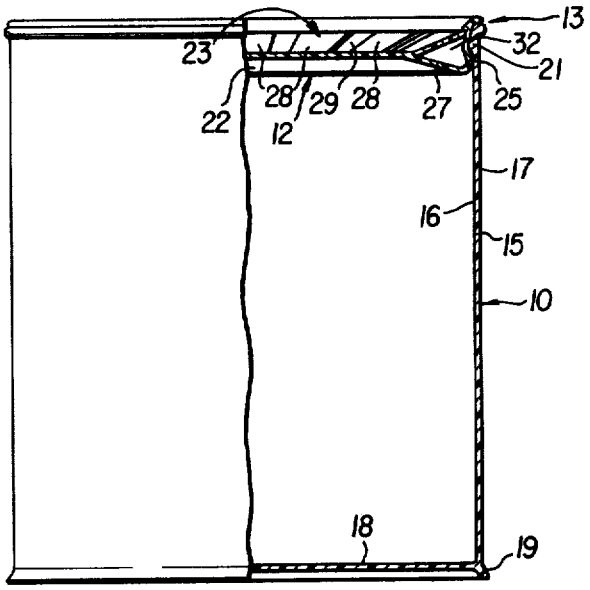
FIG. 1 is a side elevation showing a plastic can with a sealing lid inserted therein.

Referring now to the Figures, there is shown a paint container, designated generally by the numeral 10, which is sealed by a lid, designated generally by the numeral 12. Preferrably, the container 10 and the lid 12 are made by injection molding of a plastic material such as high-density polyethelyne, which has suitable flexibility and memory and has high resistance to acids and alkilies. Other plastic materials such as polypropylene, ethylene-vinyl acetate copolymers, propylene-modified polyethylene, acetals, acrylonitrile-butadiene-styrene, polystyrene blends chlorinated polyether, fluoro chemicals, polyamides, vinyls and polyvinylidene chloride. Any of the aforecited plastics may be reinforced with fibers in order to provide sufficient impact, tensil and flexural strenth.

The cylindrical container 10 has a side wall 15 defined by an inner surface 16 and an outer surface 17. The container 10 also has a bottom wall 18 and a flaired bottom flange 19 to facilitate stacking of the container. The inner wall 16 and outer wall 17 define a rim 21 around the top of the container, which rim is configured to cooperate with the lid 12 in order to establish a locking and sealing relationship between the lid and rim.

Figure 2:
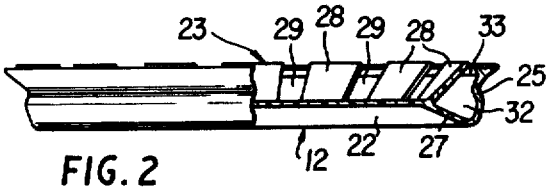
FIG. 2 is a side elevation showing the sealing lid of FIG. 1 prior to insertion.
Figure 3:
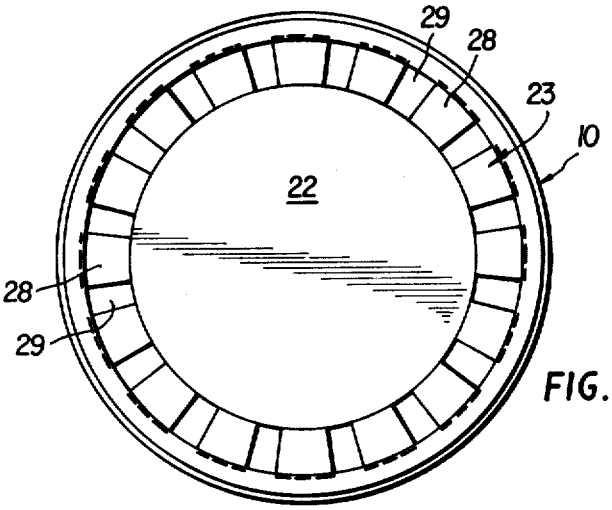
FIG. 3 is a top view of the paint can of FIG. 1 with the lid inserted.
Figure 4:
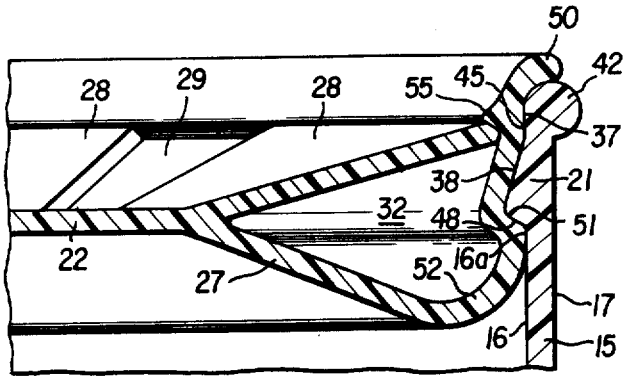
FIG. 4 is an enlarged side elevation showing the joint between the lid and the inner wall of the container.

The lid has a central portion 22 which substantially covers the opening of the container and a peripheral portion, designated generally by the number 23. As is seen in FIG. 3, the central portion 22 is circular and the peripheral portion 23 is annular. Preferrably, the peripheral portion 23 is integral with the central portion 22 and includes a continuous sealing flange 25 configured to complement the rim 21. The sealing flange 25 is joined to the central portion 22 by a web 27 that is integral with both the sealing flange and the central portion. A plurality of locking tabs 28—28 separated by spaces 29—29 project from the central portion 22 and overlie the web 27 in spaced relation thereto. The locking tabs 28—28 abut the sealing flange 25 to retain the sealing flange against the rim 21. Preferably, the spaced tabs 28—28 are integral with the central portion 22 of the lid 12 while being separate from the rim 21. In essence, the lid 12 is bifurcated to form the peripheral portion 23 so that there is a generally triangular space 32 between the tabs 28—28 and the web formed because the locking tabs 28—28 diverge radially from the central portion and laterally from the web 27. As is seen in FIG. 2, when the lid 12 is in its relaxed state, there is a relatively wide space 33 between the tabs 28—28 and the sealing flange 25. Accordingly, the lid 12 can be manufactured by injection molding in a single operation.

Considering now more specifically the cooperation between the sealing flange 25 and the rim 21, it is seen that the sealing flange has an outer sealing surface 37 with a contour that complements an inner sealing surface of 38 of the rim and an upper portion 16*a* of the inner surface 16 of the container wall 15, which upper portion is adjacent to the rim. Generally, the surface 37 has a concave contour while the surface 38 has a convex contour, so as to prohibit axial shifting of the sealing flange 25 relative to the rim 21 when the flange is held firmly against the rim by the tabs 28. The rim 21 defines the top edge of the container 10 with a bead 42 which projects outwardly beyond the outer surface 17. An inner wall portion 45 of the rim 21 extends downwardly a slight distance from the curvature of bead 42 and then diverges inwardly away from inner wall 16 over a short distance before terminating in a rounded shoulder 48. The bead 42, inner wall 45 and rounded shoulder 48 cooperate to form the convex inner contour 38 of the rim 21.

The concave outer contour 37 of sealing flange 25, which complements the inner contour 38 of rim 21, is formed by a lip 50 that overlies the bead 42 and a shoulder 51 which underlies the rounded shoulder 48 when the lid 12 is sealed. Extending downwardly from the shoulder 51 is a curved section 52 which joins the sealing flange 25 with web 27. In order to retain the tabs 28—28 behind the sealing flange 25, an inwardly facing lip 55 projects from the rear surface of the sealing flange so as to overlie the tabs when the tabs are in locking position.

The lid 12 is locked into sealing relation with the container 10 in accordance with the following steps. Initially, the lid 12 is in the relaxed state shown in FIG. 2, wherein the gap 33 exists between the lip 55 and locking tabs 28—28. Upon inserting the lid 12 into the container 10, the sealing flange 25 slides over the inner surface of the rim 21 until the sealing contour 37 on the sealing flange mates with the sealing contour 38 on the rim so that the convex configuration of the rim is received within the concave configuration of the sealing flange. While in this position, the lid 12 cannot slide axially into the container because lip 50 is abutting bead 42. Upon application of a force to the central portion 22, the locking tabs 28 slide downwardly so as to clear the lip 55. Upon thereafter releasing the force on the central portion 22, the memory in the material composing the lid 12 causes the central portion and tabs 28 to rise until the tabs seat beneath the lip 55. Thereafter, any additional forces, such as hydrostatic forces, applied against the bottom surface of the lid 12 will simple urge the tabs 28—28 into tighter engagement with the lip 55 so as to further tighten the seal between the sealing flange 25 and the rim 21. Moreover, since the tabs 28—28 are urged into abutment with the sealing flange 25 beneath the lip 55, the central portion 22 is discouraged from rising further which results in additional pressure within the container 10 urging the curved portion 52 which joins the web 27 to the sealing flange 25 to bear more tightly against the inner surface 16 of the wall 15. The shoulder 51 at the top of the curved portion 52 engages the shoulder 48 at the bottom of rim 21 so as to prevent axial movement of the lid 12 out of the can. Any increase in pressure within the container 10 only serves to tighten the engagement between shoulders 51 and 48. Accordingly, if the container 10 is dropped so as to cause a drastic increase in hydrostatic pressure with the container upon impact, the seal will be momentarily tightened to prevent the lid 12 from coming off.

In order to remove the lid 12 from the can, one need only press downward on the central portion 22 until the locking tabs 28—28 disengage from beneath the lip 55. This allows one to pry the lip 50 upward and away from bead 42, while at the same time, straightening the lower portion of the sealing contour or sealing flange 25 so as to reduce the projection of shoulder 51, allowing the shoulder 51 to clear the shoulder 48. Moreover, since the sealing flange 25 is no longer restrained by the locking tabs 28—28, the sealing flange 25 can be pushed inwardly a sufficient distance to hold the curved section 52 sufficiently bowed to allow further clearance between the shoulders 48 and 51. Accordingly, the lid 12 can be easily removed from the container 10 upon downwardly deflecting the central portion 22 and prying the lid up.

The aforedescribed structure provides a lid 12 which may be initially inserted into the container 10 by currently utilized lid-closure machinery after the container has been filled with paint at the factory. After the container 10 has been purchased, the lid 12 may be removed and replaced at the purchaser's convenience.

In order to facilitate seating the tabs 28—28 beneath the lip 55 should the memory of the material not be such as to seat the tabs automatically, a plate or ring (not shown) may be provided with the lid 12, which plate or ring has a diameter sufficient to engage all of the locking tabs 28—28 at once so that when the lid is placed in the opening of the container, the tabs may be seated simultaneously by pushing the ring or plate against the tabs. The ring or plate may be either separate from the tabs 28—28 or attached thereto.

The foregoing example is merely illustrative of the invention which is to be limited only by the following claims:

I claim:

1. A lid for closing an opening in a container wherein the lid engages an inner wall of the container, the lid comprising:

a central portion for substantially covering the opening, and a bifucated securing portion integral with and extending from the central portion, said bifucated portion comprising a sealing flange, a web connecting the sealing flange to the central portion and locking tab means diverging from the web wherein the sealing flange extends beyond the locking tab means and the locking tab means seats behind the sealing flange for holding the sealing flange in abutment with the inner wall of the container.

2. The lid of claim 1 wherein the tab means comprises a plurality of tabs spaced apart from one another.

3. The lid of claim 2 wherein the sealing flange includes a lip thereon extending toward the central portion and wherein the locking tab means fits beneath the lip when seated behind the sealing flange.

4. The lid of claim 3 wherein the container with which the lid is used includes an inwardly projecting, generally convex, sealing surface and wherein the sealing flange of the container includes a generally concave sealing surface which complements the generally convex sealing surface on the container to prevent axial displacement of the lid with respect to the axis of the container.

5. The lid of claim 4 wherein the generally concave sealing surface of the sealing flange includes a lip for overlying the top of the container and a projecting shoulder for underlying a complementary shoulder on the container.

6. The lid of claim 1, 2, 3, 4, or 5 wherein the lid is made of plastic.

7. In combination, a lid and a container having an opening which is sealed by the lid, the combination comprising:

a rim on the container adjacent to the opening, the rim having an inwardly facing sealing surface;

the lid having a unitary structure including a central portion substantially closing the opening and a bifucated securing portion, the bifucated securing portion having a web portion, a sealing flange and locking tab means, wherein the web portion connects the sealing flange to the central portion; wherein the locking tab means diverges radially from the central portion and laterally from the web portion to form the bifucated securing portion and seats behind the sealing flange to lock the sealing flange in place against the rim, and wherein the sealing flange includes an outwardly facing sealing surface which complements the inwardly facing sealing surface of the rim.

8. The combination of claim 7 wherein the locking tab means comprises a plurality of spaced apart tabs.

9. The combination of claim 8 wherein the flange includes lip means projecting toward the central portion beneath which lip means the tabs seat.

10. The combination of claim 9 wherein the inwardly facing sealing surface of the rim is generally convex in contour while the outwardly facing sealing surface of the sealing flange is generally concave in contour and complements the contour of the inwardly facing surface to provide a sealing relationship.

11. The combination of claim 10 wherein the rim includes a bead at the opening of the container and a shoulder projecting into the container and facing away from the opening, the bead and lip cooperating to form the convex contour, and wherein the sealing flange includes an outwardly projecting lip which fits over the bead and an outwardly projecting shoulder which seats beneath the shoulder on the rim, the lip and outwardly facing shoulder forming the concave sealing surface of 12. The combination of claim 7, 8, 9, 10 or 11 wherein the lid and container are made of plastic.

13. The combination of claim 7, 8, 9, 10 or 11 wherein at least the lid is made of plastic.

14. A lid made of plastic for closing an opening in a container wherein the lid engages an inner wall of the container, the lid comprising:

a central portion for substantially covering the opening;

a bifucated securing portion integral with and extending from the central portion to the inner wall of the container with which the lid is used; said bifucated securing portion including sealing flange means extending generally normally to the central portion when the lid is in place to close the container and having a sealing surface for engagement with the inner wall of the container, web means for connecting the sealing flange to the central portion and locking tab means projecting over the web means and seating behind the sealing flange to secure the sealing flange in abutment with the inner wall of the container.

15. The lid of claim 14 wherein the locking tab means comprises a plurality of tabs spaced apart from one another.

* * * * *